United States Patent [19]

Cox et al.

[11] Patent Number: 5,058,812

[45] Date of Patent: Oct. 22, 1991

[54] SYSTEM FOR DISPENSING OF BOTH WATER BASE AND ORGANIC SOLVENT BASE COATINGS

[75] Inventors: Jack L. Cox, Thorntown; James A. Scharfenberger, Indianapolis, both of Ind.

[73] Assignee: Ransburg Corporation, Indianapolis, Ind.

[21] Appl. No.: 582,895

[22] PCT Filed: Jun. 5, 1989

[86] PCT No.: PCT/US89/02444

§ 371 Date: Oct. 9, 1990

§ 102(e) Date: Oct. 9, 1990

[51] Int. Cl.[5] ..... B05B 5/04

[52] U.S. Cl. ..... 239/691; 239/690.1; 239/703; 239/706; 118/629

[58] Field of Search ..... 239/690, 690.1, 691, 239/695, 699, 700, 703, 708, 706, 302, 303, 304, 305; 118/629; 427/27

[56] References Cited

U.S. PATENT DOCUMENTS

| | | | |
|---|---|---|---|
| 1,655,262 | 1/1928 | Fortin . | |
| 2,673,232 | 3/1954 | Silsby, Jr. . | |
| 3,098,890 | 7/1963 | Peterson . | |
| 3,122,320 | 2/1964 | Beck et al. . | |
| 3,291,889 | 12/1966 | Uline et al. . | |
| 3,360,035 | 12/1967 | Van Loo et al. . | |
| 3,892,357 | 7/1975 | Tamny | 118/629 |
| 3,893,620 | 9/1975 | Rokadia | 239/3 |
| 3,933,285 | 1/1976 | Wiggins . | |
| 3,934,055 | 1/1976 | Tamny . | |
| 4,017,029 | 4/1977 | Walberg | 239/691 |
| 4,020,866 | 5/1977 | Wiggins | 239/3 |
| 4,085,892 | 4/1978 | Dalton | 239/707 |
| 4,148,932 | 4/1979 | Tada et al. | 239/703 |
| 4,313,475 | 2/1982 | Wiggins | 118/506 |
| 4,413,788 | 11/1983 | Schaefer et al. . | |
| 4,613,076 | 9/1986 | Dietz et al. | 239/703 |
| 4,724,154 | 2/1988 | Cosentino et al. | 118/629 |

FOREIGN PATENT DOCUMENTS

| | | |
|---|---|---|
| 1393333 | 5/1975 | United Kingdom . |
| 1478853 | 7/1977 | United Kingdom . |

*Primary Examiner*—Andres Kashnikow
*Assistant Examiner*—Christopher G. Trainor
*Attorney, Agent, or Firm*—Barnes & Thornburg

[57] ABSTRACT

An electrode (60) for electrically charging dispensed coating material is electrically substantially isolated from the coating material dispensing device (16). Sources provide first (30–36) and second (70–76) coating materials, the first (30–36) of which is electrically substantially more conductive and the second (70–76) of which is electrically substantially less conductive. The first (30–36) or the second (70–76) coating material is alternately supplied to the coating material dispensing device (16). A high-magnitude electrostatic potential supply (58) provides electrostatic high potential to the electrode (60) and selectively to the coating material dispensing device (16). The high-magnitude electrostatic potential supply (58) is coupled (62) to the coating material dispensing device (16) when the second coating material (70–76) is supplied to the coating material dispensing device (16) and is uncoupled (62) from the coating material dispensing device (16) when the first coating material (30–36) is supplied to the coating material dispensing device (16).

7 Claims, 1 Drawing Sheet

SYSTEM FOR DISPENSING OF BOTH WATER BASE AND ORGANIC SOLVENT BASE COATINGS

Figure 1:
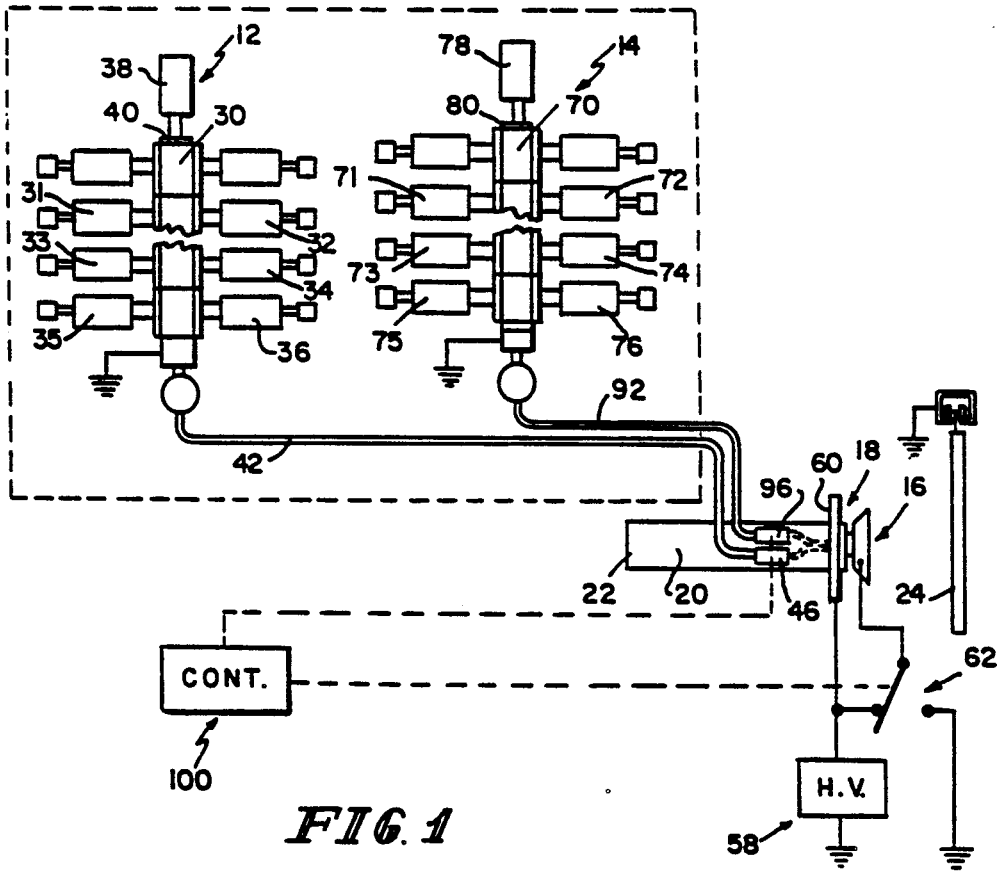

This invention relates to electrostatically aided atomization and dispensing systems for coating materials and more particularly to systems Which are able to dispense both electrically more conductive coating materials such as metallic and water-based coating materials, and electrically less conductive Coating materials such as organic solvent-based coating materials.

In many modern coating material application facilities, different types of coating materials are required to be dispensed. For example, many of the coating materials used to coat automotive vehicle bodies are electrically highly conductive, while others are substantially less conductive. Examples of highly conductive coating materials for such applications include metallic coating materials and water-based coating materials. An example of a substantially less conductive coating material for such applications is a non-metallic organic solvent-based coating material It is common in industries such as the automotive industry to use electrostatically aided atomization and dispensing processes in the application of coating materials. These processes are noted for their transfer efficiencies and resulting reduced usage requirements of coating materials. However, a problem exists when electrostatically aided atomization and dispensing processes are used to dispense highly conductive coating materials. That problem is isolation of the electrostatic high potential source from ground. It has been addressed frequently in the prior art, as demonstrated by the following references U.S. Pat. Nos. 1,655 262; 2 673 232; 3,098,890; 3,291,889 3,360,035; 4,020,866; 3,122,320; 3,893,620; 3,933,285; 3,934,055; 4,017,029; 4,275,834; 4,313,475; 4,085,892; 4,413,788; British Patent Specification 1,478,853 and British Patent Specification 1,393,333. This listing and other prior art listings herein are not intended to be exhaustive, or to be interpreted as representations that no better prior art exists.

Because of the large capital and floor space requirements of coating material application lines for facilities such as automotive vehicle assembly plants, it is generally undesirable to provide separate lines for applying highly conductive and generally non-conductive coating materials. In addition, each different conductive coating material practically requires a separate Coating material dispensing system. This further complicates the application of conductive coating materials.

Accordingly it is an object of the present invention to propose a coating material dispensing system which has the flexibility to dispense both the more highly conductive types of coating materials as well as those less conductive types.

A coating material dispensing facility according to the present invention includes a coating material dispensing device and an electrode electrically substantially isolated from the coating material dispensing device. Illustratively the electrode is of the type described in PCT/US88/02107 filed June 13, 1988 titled SPRAY COATING DEVICE FOR ELECTRICALLY CONDUCTIVE COATING LIQUIDS and assigned to the same assignee as this application The facility also includes a source of first and second coating materials, the first coating material being electrically substantially more conductive and the second being electrically substantially less conductive. First means are provided for alternately supplying either the first coating material or the second to the coating material dispensing device. Electrostatic high potential is provided, as is second means for coupling the electrostatic high potential to the electrode and the dispensing device. The second means selectively couples the electrostatic high potential to the coating material dispensing device only when the first means supplies the second coating material to the dispensing device.

Figure 2:
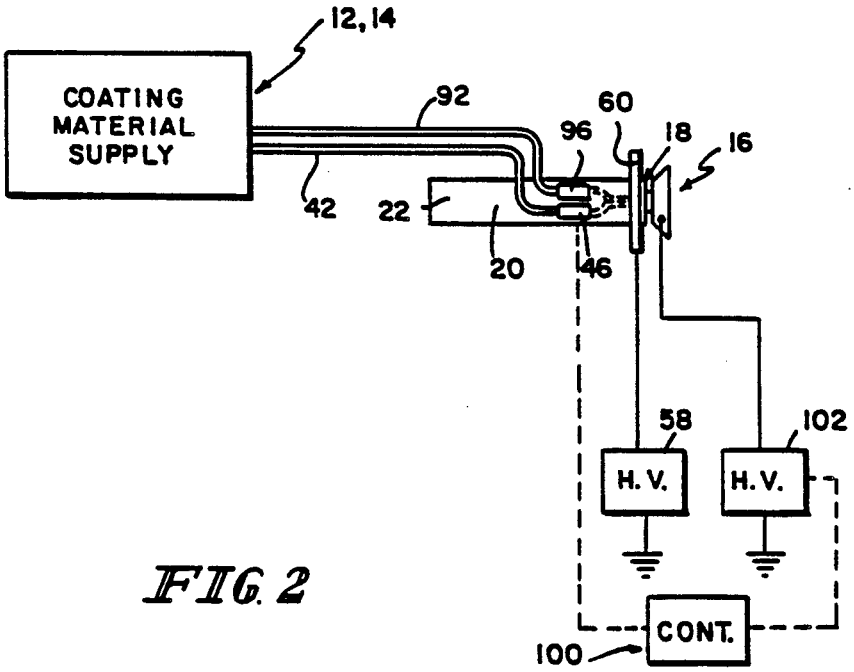

The invention may best be understood by referring to the following description and accompanying drawings which illustrate the invention. In the drawings:

FIG. 1 illustrates a highly diagrammatic side elevational view of a system constructed according to the invention; and FIG. 2 illustrates a highly diagrammatic side elevational view of another system constructed according to the invention.

Referring now to FIG. 1, two parallel coating material circuits 12, 14 alternately provide selected coating materials, for example, coating materials of different colors, of one of two different types, to a dispensing device 16. Electrically substantially more conductive coating materials are dispensed by circuit 12 and electrically substantially less conductive coating materials are dispensed through circuit 14. Dispensing device 16 of the type described in, for example, U.S. Pat. No. 4,148,932, is mounted from one end 18 of a support 20, the other end 22 of which can be mounted to permit movement of dispensing device 16 as it dispenses coating material onto an article 24 to be coated, a "target," passing before it. Of course, any other suitable type of dispensing device can also be used, such as an air atomizer, a hydraulic atomizer, and air assisted hydraulic atomizer, and so on. Support 20 is constructed from an electrical insulator to isolate dispensing device 16 from ground potential.

Circuit 12 includes a color manifold 30, illustrated fragmentarily. Color manifold 30 includes a plurality of illustratively air operated color valves, six, 31–36 of which are shown. These color valves 31–36 control the flows of various selected colors of electrically more conductive coating material from individual supplies (not shown) into the color manifold 30. A solvent valve 38 is located at the head 40 of color manifold 30. A supply line 42 extends from the lowermost portion of color manifold 30 to a triggering valve 46 mounted adjacent dispensing device 16. A feed tube attached to an output port of triggering valve 46 feeds a coating material flowing through a selected one of color valves 31–36 and manifold 30 into supply line 42, through triggering valve 46 and the feed tube into the dispensing device 16. Operation of device 16 atomizes this selected color of coating material.

The coating material dispensed by device 16 moves toward a target 24 moving along a grounded conveyor due, in part, to electric forces on the dispensed particles of the coating material. To impart Charge to the particles of Coating material and permit advantage to be taken of these forces, an electrostatic high potential supply 58 is coupled to a conductive coating material electrostatic charging ring 60 of the type described in PCT/US88/02107, and through a switch 62 to device 16. Supply 58 may be any of a number of known types. The operation of switch 62 will be described subsequently.

Circuit 14 includes a color manifold 70, illustrated fragmentarily. Color manifold 70 includes a plurality of illustratively air operated color valves, six, 71–76 of which are shown. Color valves 71–76 control the flows of various selected colors of electrically less conductive coating material from individual supplies (not shown) into the color manifold 70. A solvent valve 78 is located at the head 80 of color manifold 70. A supply line 92 extends from the lowermost portion of color manifold 70 to a triggering valve 96 mounted adjacent dispensing device 16. A feed tube attached to the output port of triggering valve 96 feeds a coating material flowing through a selected one of color valves 71–76 and manifold 70 into supply line 92, through triggering valve 96, and the feed tube into the interior of dispensing device 16. Operation of device 16 atomizes this selected color of coating material.

As with the electrically more conductive coating materials dispensed from manifold 30, the coating material dispensed from manifold 70 by device 16 moves toward target 24 moving along the grounded conveyor due, in part, to electric forces on the dispensed particles of the coating material.

When an electrically less conductive coating material supplied through manifold 70 is being dispensed, there is very little possibility of substantial current flow from supply 58 to device 16 and from device 16 back down the column of coating material in supply line 92 to the ground at manifold 70. Consequently, when an electrically less conductive coating material is being dispensed, that is, when triggering valve 96 is open, switch 62 is in its position illustrated in FIG. 1. On the other hand, when an electrically more conductive coating material supplied through manifold 30 is being dispensed, there is a substantially greater possibility of substantial current flow from supply 58 to device 16 and from device 16 back down the column of coating material in supply line 42 to the ground at manifold 30. Consequently, when an electrically more conductive coating material is being dispensed, that is, when triggering valve 46 is open, switch 62 is in its position in which device 16 is maintained at ground potential. When switch 62 is in this position, all of the charging of the coating material is achieved by the mechanisms described in PCT/US88/02107.

The control of the position of switch 62 to correspond with the position of triggering valve 46 is achieved by a controller 100 of any of a number of known types.

It should be understood that when a less conductive coating material is dispensed, care should be taken that no residue of a more highly conductive coating material remains in supply line 42. Otherwise, a conductive path may exist from device 16 down line 42 when supply 58 is trying to maintain device 16 at a high magnitude electrostatic potential.

In an alternative embodiment of the invention illustrated in FIG. 2, those elements which have the same functions as elements illustrated in FIG. 1 are designated by the same reference numbers. The only difference between the embodiments of FIGS. 1 and 2 is that supply 58 supplies high potential to ring 60, while a separate electrostatic high potential supply 102 supplies high magnitude electrostatic potential under the control of controller 100 to device 16. When device 16 is coupled to high magnitude electrostatic potential, an electrically less conductive coating material is being dispensed.

What is claimed is:

1. In combination, a coating material dispensing device, an electrode for electrically charging dispensed coating material, the electrode being electrically substantially isolated from the coating material dispensing device, a source of first and second coating materials, the first coating material being electrically substantially more conductive and the second coating material being electrically substantially less conductive, first means for alternately supplying either the first coating material or the second coating material to the coating material dispensing device, means providing electrostatic high potential, second means for coupling the electrostatic high potential providing means to the electrode and for selectively coupling the electrostatic high potential providing means to the coating material dispensing device, the second means operating to couple the electrostatic high potential providing means to the coating material dispensing device when the first means supplies the second coating material to the coating material dispensing device and to uncouple the electrostatic high potential providing means from the coating material dispensing device when the first means supplies the first coating material to the coating material dispensing device.

2. The combination of claim 1 wherein the dispensing device is a rotary atomizing and dispensing device.

3. The combination of claim 2 wherein the electrode is ring-shaped and has an axis with respect to which it is generally symmetrical, the axis of symmetry of the electrode lying generally parallel to the axis of rotation of the rotary atomizing and dispensing device.

4. The combination of claim 3 wherein the electrode and dispensing device are coaxial.

5. The combination of claim 2 wherein the dispensing device includes a generally circular atomizing edge defining a plane from which atomized coating material is projected generally toward a first side of the plane, the electrode generally surrounds the axis of rotation of the dispensing device and is positioned on a second side of the plane opposite the first.

6. The combination of claim 1 wherein the electrode is ring-shaped.

7. In combination, a coating material dispensing device, a coating material charging ring electrically substantially isolated from the coating material dispensing device, a source of electrically more highly conductive first coating material, a source of second coating material electrically substantially less conductive than the first coating material, first means for alternately supplying either the first coating material or the second coating material to the coating material dispensing device, means providing an electrostatic high potential, means for coupling the electrostatic high potential providing means to the charging ring, second means for selectively coupling the electrostatic high potential providing means to the coating material dispensing device, the second means operating to couple the electrostatic high potential providing means to the coating material dispensing device when the first means supplies the second coating material to the coating material dispensing device and to uncouple the electrostatic high potential providing means from the coating material dispensing device when the first means supplies the first coating material to the coating material dispensing device.

* * * * *